United States Patent [19]

Helton et al.

[11] 4,088,429

[45] May 9, 1978

[54] SPHERICAL SHOT PRODUCING MACHINE

[75] Inventors: Eugene L. Helton, Peoria; Gerald P. Simmons, Washington, both of Ill.

[73] Assignee: Caterpillar Tractor Co., Peoria, Ill.

[21] Appl. No.: 817,329

[22] Filed: Jul. 20, 1977

Related U.S. Application Data

[63] Continuation of Ser. No. 689,612, May 24, 1976, abandoned.

[51] Int. Cl.[2] ..... B29C 23/00; B22D 23/08

[52] U.S. Cl. ..... 425/8

[58] Field of Search ..... 425/8, 6

[56] References Cited

U.S. PATENT DOCUMENTS

| | | | |
|---|---|---|---|
| 1,210,097 | 12/1916 | Perry et al. | 425/8 X |
| 2,439,772 | 4/1948 | Gow | 425/8 X |
| 2,439,776 | 4/1948 | Klein et al. | 425/8 |
| 3,266,085 | 8/1966 | Nacke | 425/8 |
| 3,293,695 | 12/1966 | Baymiller et al. | 425/8 |
| 3,797,978 | 3/1974 | Young et al. | 425/8 |

*Primary Examiner*—J. Howard Flint, Jr.
*Attorney, Agent, or Firm*—Phillips, Moore, Weissenberger, Lempio & Majestic

[57] ABSTRACT

A shot producing machine includes a rotatable vessel containing molten metal, the rotation of such vessel throwing the molten metal therefrom in the form of spherical droplets. The spherical droplets are caused to pass through a liquid spray whereby they are solidified into pellets, and thereafter fall to the bottom of a receiving vessel for collection.

6 Claims, 2 Drawing Figures

SPHERICAL SHOT PRODUCING MACHINE

This is a continuation, of Ser. No. 689,612, filed May 24, 1976, now abandoned.

BACKGROUND OF THE INVENTION

This invention relates to production of metallic shot in the form of pellets, and more particularly to apparatus for producing such pellets.

A well-known method of producing generally spherical metal pellets is disclosed in U.S. Pat. No. 2,567,121. As disclosed therein, molten metal is allowed to flow onto an angled surface past a series of jets or nozzles which break up the flowing metal into globules of molten metal which are then quenched in a bath. While such a system has proven relatively effective in operation, it has been found that the maintenance of proper thickness of the stream of molten metal passing adjacent the jets or nozzles is quite critical, and requires a relatively high degree of care and adjustment of the angle of the receiving surface for the proper maintenance thereof. Somewhat similar is British Specification No. 1,201,451 disclosing molten metal striking a fixed plate to break up into small globules.

In U.S. Pat. No. 3,814,558, apparatus for producing metal powders is disclosed. As shown, molten metal is introduced into a chamber which is caused to have a vacuum therein, necessitating a higher degree of complication than might be deemed desirable. And, in U.S. Pat. No. 2,978,742 and U.S. Pat. No. 3,677,669, rows of orifices are provided to release drops of molten metal into a body of quenching solution. Again, while such a system has been found to be relatively effective in operation, it is to be understood that increase and efficiency in speed in producing relatively large amounts of metal pellets is desirable.

SUMMARY OF THE INVENTION

It is accordingly an object of this invention to provide apparatus for producing generally spherical metal pellets wherein such pellets are produced in a highly efficient manner and at relatively low cost.

It is a further object of this invention to provide apparatus for producing generally spherical metal pellets which, while fulfilling the above object, does not depend for its operation on the maintenance of a vecuum or pressure within the system.

It is a further object of this invention to provide apparatus for producing generally spherical metal pellets which, while fulfilling the above objects, provides for proper cooling of metal pellets being formed from molten metal.

It is a still further object of this invention to provide an apparatus for producing generally spherical metal pellets which is extremely simple and effective in practice.

Broadly stated, the apparatus for producing generally spherical metal pellets comprises frame means and a vessel rotatably mounted relative to the frame means. Means are included for rotating the vessel relative to the frame means. Means are included for supplying molten metal to the vessel, the rotation of the vessel causing molten metal to be thrown therefrom in the form of generally spherical droplets. Means are included for providing cooling liquid with which the generally spherical droplets are brought into contact, to cool the generally spherical droplets.

Broadly stated, the invention comprises an apparatus for use in a method of producing generally spherical metal pellets comprising rotating a vessel holding molten metal so that the molten metal is thrown therefrom in the form of generally spherical droplets, and bringing said generally spherical droplets into contact with a liquid to cool said generally spherical droplets.

BRIEF DESCRIPTION OF THE DRAWINGS

These and other objects of the invention will become apparent from a study of the following specification and drawings, in which.

DESCRIPTION OF THE PREFERRED EMBODIMENT

Figure 1:
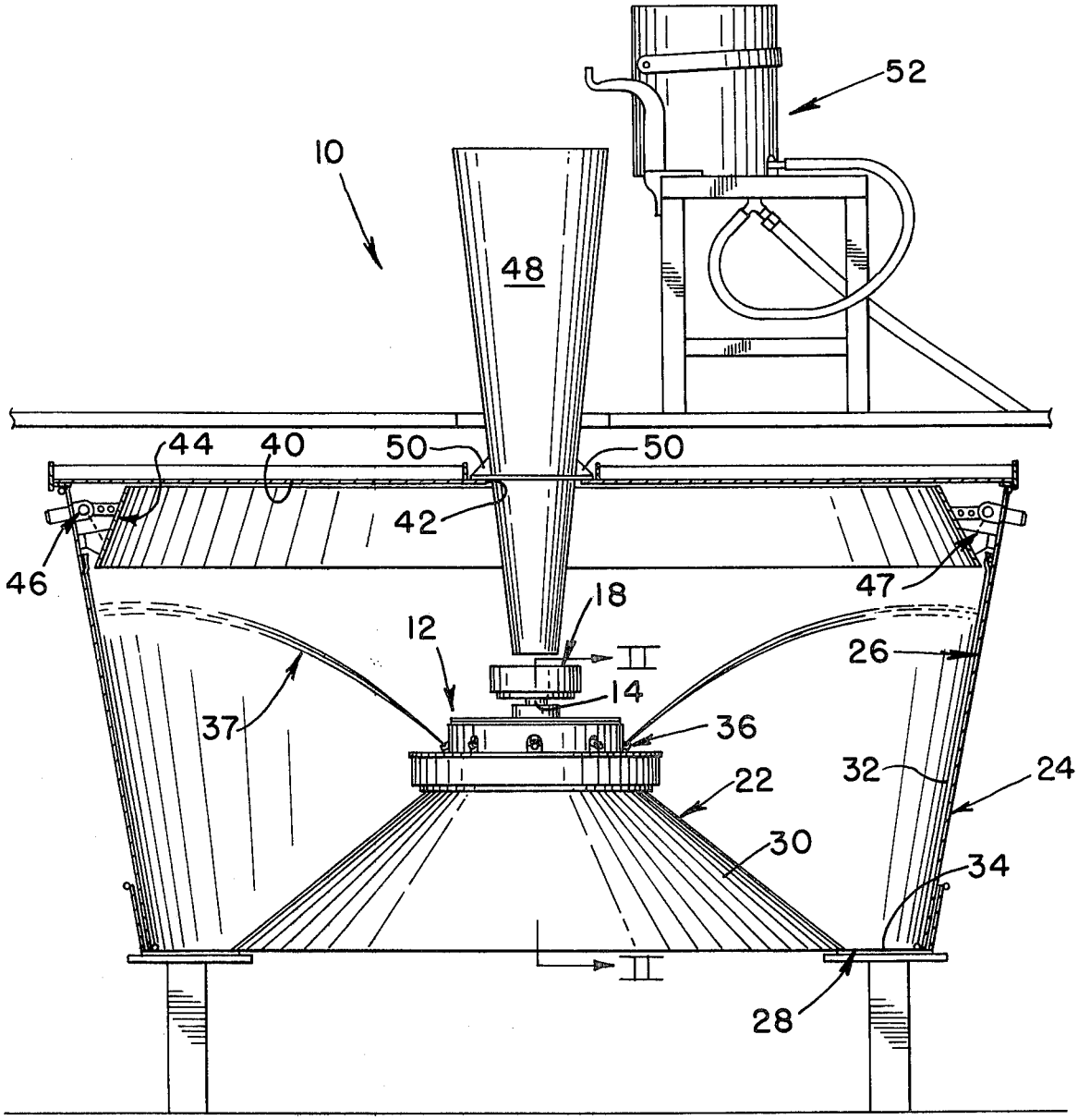
FIG. 1 is a side elevation, partially in section, of the apparatus for producing metallic pellets.
Figure 2:
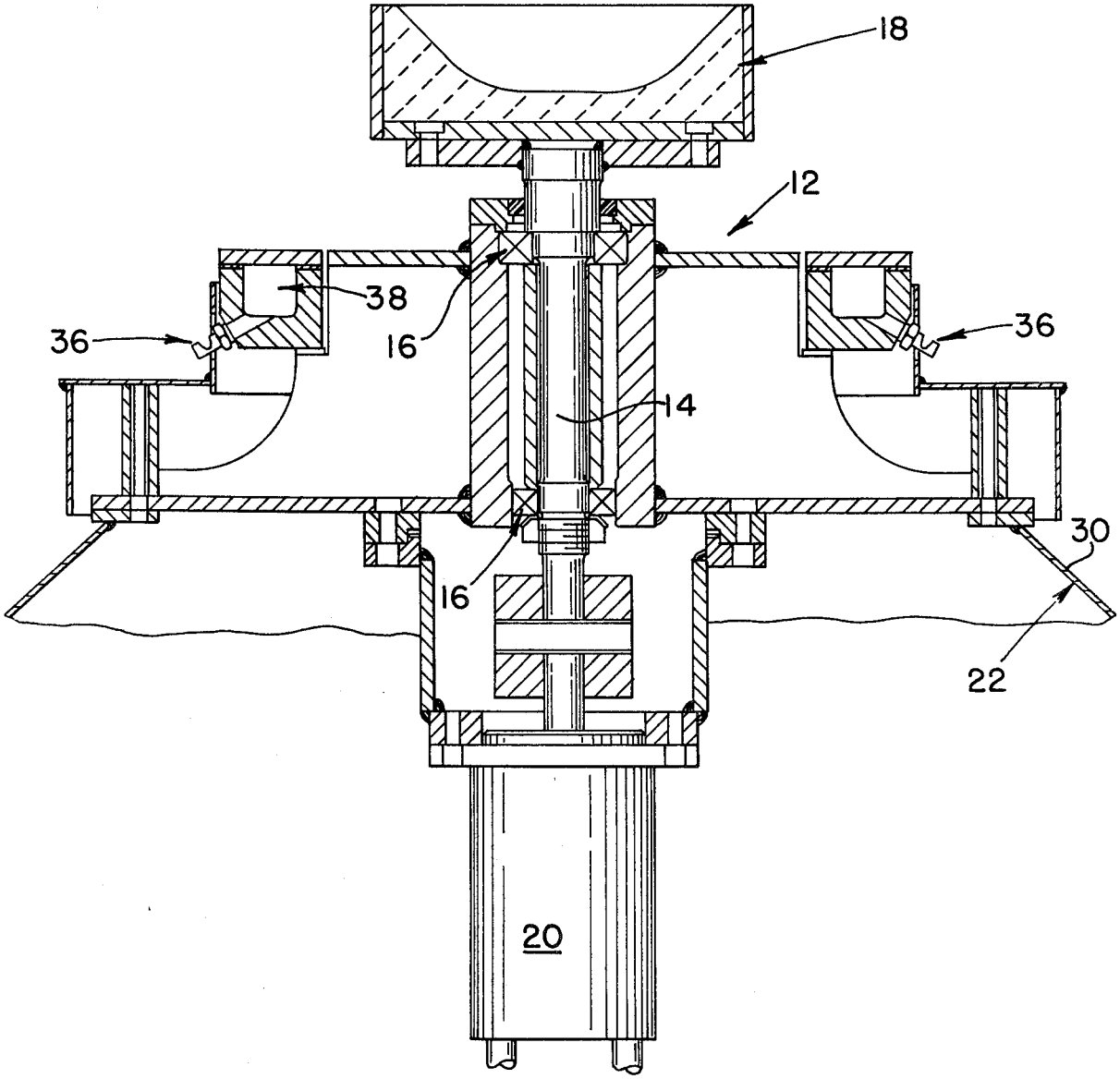
FIG. 2 is a sectional view taken along the line II—II of FIG. 1.

Shown in FIG. 1 is the overall apparatus 10 for producing generally spherical metal pellets or shot. The apparatus 10 includes frame means 12 (FIG. 2) to which is rotatably mounted a shaft 14, the shaft 14 being vertically disposed and supported in bearings 16. The upper portion of the shaft 14 has fixed thereto a vessel 18 in the form of a crucible, so that the vessel 18 is rotatably mounted relative to the frame means 12. A motor 20 is drivingly engaged with the lower end of the shaft 14, such motor 20 being fixed to the frame means 12. The motor 20 may be actuated in a well-known manner to rotate the shaft 14 about its longitudinal axis, to in turn rotate the vessel 18 about an axis of rotation coincident with the longitudinal axis of the shaft 14.

Fixed to the frame means 12 and extending downwardly and outwardly thereof is an inner wall 22 which makes up part of a receiving vessel 24. The receiving vessel 24 is in fact made up of an outer wall 26, the inner wall 22, and an annular bottom wall 28 interconnecting the inner and outer walls 22, 26. The outer surface 30 of the inner wall 22 is frusto-conical in configuration, being tapered outwardly in a downward direction, and the inner surface 32 of the outer wall 26 is frusto-conical in configuration, being tapered inwardly in a downward direction. The upper surface 34 of the bottom wall 28 is substantially horizontal in disposition.

A plurality of liquid spray nozzles 36 are fixed to the frame means 12 about the shaft 14, and such spray nozzles 36 may be supplied with liquid which is introduced into a chamber 38 communicating with the nozzles 36. The receiving vessel 24 also includes a top plate 40 secured to the upper annular edge of the outer wall 26, and providing a central opening 42 therein. A frusto-conical apron 44 is secured to the lower surface of the top plate 40, and another plurality of liquid spray nozzles 46 are positioned inwardly of the outer wall 26 and slightly below the top plate 40 but outwardly of the apron 44. Such spray nozzles 46 may be supplied with liquid in a well-known manner.

A funnel 48 is disposed through the opening 42 and has legs 50 fixed to the outer surface thereof and fixed to the top plate 40 adjacent the opening 42, and legs 50 having spaces therebetween so that the inside of the vessel 24, and all elements therein, including the rotatable vessel 18, are exposed to atmosphere. The lower end of the funnel 48 terminates just above the vessel 18, and molten metal may be supplied to the funnel 48 to be directed to the vessel 18 from an apparatus 52 so supplying molten metal.

In the operation of the apparatus 10, the vessel 18 is rotated relative to the frame means 12 by use of the motor 20 rotating the shaft 14, and molten metal is supplied to the funnel 48 and therethrough to the rotating vessel 18. Meanwhile, liquid is supplied to the nozzles 36, such nozzles 36 being directed so that the spray 37 therefrom takes place substantially 360° about the axis of rotation of the vessel 18. The rotation of the vessel 18 causes droplets of molten metal to be thrown off such vessel 18 by centrifugal force, the size of the droplets being a function of the speed of rotation of the vessel 18. It has been found that such droplets being thrown from the vessel 18 are generally spherical in configuration. The droplets are thrown 360° about the axis of rotation of the vessel 18, and were it not for the particular placement of the nozzles 36 to direct liquid, as shown in FIG. 1, against the inner surface 32 of the outer wall 26, such droplets would be thrown against the inner surface 32 of the outer wall 26, resulting in the fact that such droplets would no longer be generally spherical in configuration. However, the liquid spray 37 from the nozzles 36 is positioned relative to the rotating vessel 18 so that the droplets pass therethrough, being cooled and solidified thereby. It is insured that such cooling and solidifying takes place through the utilization of the 360° spray 37 as described. With the droplets passing through the liquid spray 37, they are solidified so that when they contact the inner surface 32 of the outer wall 26, their shape is already set in the form of generally spherical pellets.

The nozzles 46 are positioned to direct the spray 47 therefrom onto the apron 44, and downwardly therefrom onto the inner surface 32 of the outer wall 26. Thus, flow of liquid is provided downwardly along the inner surface 32 of the outer wall 26 to the bottom wall 28.

It will likewise be seen that the liquid spray 47 from the nozzles 46 also runs down the inner surface 32 of the outer wall 26, to the bottom wall 28. Such liquid is allowed to run from the vessel 24, but the opening through which such liquid is allowed to leave vessel 24 is sized so that the liquid is held at a level of approximately two inches in the vessel 24. Such liquid running down the wall 26 and collecting at the bottom of the vessel 24 further acts to cool the solidified pellets collecting at the bottom of the vessel 24.

Because of the particular features of this invention, i.e. in particular the use of a rotating vessel 18 for throwing molten metal in the form of generally spherical droplets, and the critical placement of cooling liquid spray through which the droplets pass and by which such droplets are solidified, it has been found that a relatively high uniform plurality of pellets are produced. The apparatus has also been found to be capable of producing a high number of pellets in a relatively short time. Overall, it will be seen that the apparatus is extremely simple in design, and the method of use thereof extremely efficient in practice.

What is claimed is:

1. An apparatus for producing generally spherical metal pellets comprising:

frame means;

a vessel rotatably mounted relative said frame means;

means for rotating said vessel relative said frame means;

funnel means fixed relative said frame means for supplying moten metal to said vessel, the rotation of the vessel causing molten metal to be thrown outwardly therefrom in the form of generally spherical droplets;

first spray means fixed relative said frame means and disposed below said rotatable vessel for spraying cooling liquid generally upwardly through the path of the generally spherical droplets thrown outwardly from said vessel to solidify said generally spherical droplets whereby generally spherical metal pellets are formed; and receiving means fixed relative said frame means for receiving pellets, said receiving means comprising a frusto-conical outer wall, an inner wall, and a horizontally oriented bottom wall interconnecting said inner and outer walls, the frustoconical outer wall being positioned generally about the vessel and tapering inwardly toward the bottom wall so that said generally spherical metal pellets contact the inner surface of said outer wall and fall downwardly therealong to said bottom wall, said cooling liquid from said first spray means further directed against an inner surface of said frustoconical outer wall.

2. The apparatus set forth in claim 1 further comprising second spray means fixed relative said frame means for providing cooling liquid directed downwardly along the inner surface of the frustoconical outer wall, said cooling liquid from said second spray means and the cooling liquid from the first spray means forming a downwardly running stream of water along the inner surface of said frustoconical outer wall.

3. An apparatus for producing generally spherical metal pellets comprising:

frame means;

a vessel rotatably mounted relative said frame means;

funnel means fixed relative said frame means for supplying molten metal to said vessel, the rotation of said vessel causing molten metal to be thrown outwardly therefrom in the form of generally spherical droplets;

first spray means for spraying cooling liquid generally outwardly through the path of the generally spherical droplets thrown outwardly from said vessel to solidify said generally spherical droplets whereby generally spherical metal pellets are formed;

receiving means fixed relative said frame means for receiving said pellets, said receiving means comprising a frustoconical outer wall, an inner wall, and a horizontally oriented bottom wall interconnecting said inner wall and said outer wall, said frustoconical outer wall being positioned normally about the vessel and tapering inwardly towards said bottom wall so that the spherical metal pellets contact the inner surface of said outer wall and fall downwardly therealong to said bottom wall, said cooling liquid from said first spray means further directed against said inner surface of said frustoconical outer wall; and second spray means for providing additional cooling liquid directed downwardly along the inner surface of the frustoconical outer wall, said cooling liquid from said second spray means and said cooling liquid from said first spray means forming a downwardly running stream of water along the inner surface of said frustoconical outer wall.

4. The apparatus set forth in claim 3 wherein the first spray means is fixed relative said frame means and disposed below said rotatable vessel.

5. The apparatus set forth in claim 4 wherein the second spray means is fixed relative said frame means generally adjacent the upper end of said frustoconical outer wall.

6. The apparatus set forth in claim 5 wherein the second spray means comprises a spray nozzle and a frustoconical apron disposed in the frustoconical outer wall tapering outwardly in a downward direction for directing cooling liquid from the spray nozzle to generally the upper end of the inner surface of said frustoconical outer wall.

* * * * *